United States Patent [19]

Rampley et al.

[11] Patent Number: 4,995,807

[45] Date of Patent: Feb. 26, 1991

[54] FLUE GAS RECIRCULATION SYSTEM

[75] Inventors: Thomas N. Rampley; Paul G. Hoffarth, both of Peru, Ind.

[73] Assignee: Bryan Steam Corporation, Peru, Ind.

[21] Appl. No.: 326,161

[22] Filed: Mar. 20, 1989

[51] Int. Cl.[5] ..... F23L 7/00

[52] U.S. Cl. ..... 431/9; 431/115

[58] Field of Search ..... 431/115, 116, 9

[56] References Cited

U.S. PATENT DOCUMENTS

| | | | |
|---|---|---|---|
| 385,072 | 6/1888 | Schlimme . | |
| 727,410 | 5/1903 | McAllister . | |
| 1,101,790 | 6/1914 | Doherty . | |
| 1,629,253 | 5/1927 | Breese | 431/115 |
| 2,258,515 | 10/1941 | Mowat | 431/9 |
| 3,097,686 | 7/1963 | Morrow . | |
| 3,781,162 | 12/1973 | Rudd et al. . | |
| 3,868,211 | 2/1975 | Haye et al. . | |
| 3,880,570 | 4/1975 | Marshall . | |
| 4,061,463 | 12/1977 | Bennett . | |
| 4,294,178 | 10/1981 | Borio et al. . . | |

*Primary Examiner*—Carroll B. Dority

*Attorney, Agent, or Firm*—Barnes & Thornburg

[57] ABSTRACT

A system is provided for reducing the amount of nitrogen oxides produced by conventional gas-fired boilers, water heaters, or other heat transfer devices by diluting the fuel gas with an inert gas. The system includes a mixing unit or region for diluting fuel gas with an inert gas before the fuel gas is supplied to a burner assembly of a combustion device. Flue gas from the combustion chamber of the combustion device may be used to dilute the fuel gas.

13 Claims, 2 Drawing Sheets

FLUE GAS RECIRCULATION SYSTEM

BACKGROUND AND SUMMARY OF THE INVENTION

The present invention relates to a system and method for reducing the formation of nitrogen oxides by gas fuel burner assemblies during a combustion process. More particularly, the present invention relates to a system for mixing an inert gas, such as combustion product generated by the fuel burner assembly, with a fuel gas to dilute the fuel gas prior to introducing the fuel gas into the burner assembly.

In recent years, concern about air pollution has grown, especially in larger cities across the United States. Due to this growing concern about air pollution, governmental regulations have been enacted to control various types of air pollutants created during typical combustion processes.

Nitrogen oxides are one group of air pollutants which have been targeted by regulatory bodies for increasingly stringent controls. Nitrogen oxides, often referred to by the symbol $NO_x$, include both nitric oxide (NO) and nitrogen dioxide ($NO_2$). Nitric oxide and nitrogen dioxide are both often contained in the combustion product created during combustion processes. Upon release into the atmosphere, nitrogen oxides mix with water vapor to form nitrous and nitric acid. These acids can cause photochemical smog and acid rain.

Nitrogen oxides are formed during combustion of natural gas, fuel oils, and other fuels by oxidation of nitrogen contained in the combustion air and by oxidation of "fuel bound nitrogen" which is chemically attached to the fuel. As the intensity of the flame of a combustion device increases, the temperature of the flame also increases which in turn increases the amount of nitrogen in the combustion air that is oxidized during the combustion reaction.

In combustion processes which utilize fuel oil, fuel bound nitrogen can provide up to 60 percent of the resultant nitrogen oxides contained in the combustion product. The remaining 40 percent of the nitrogen oxides contained in combustion product from a fuel oil combustion process is formed by oxidation of nitrogen supplied as part of the combustion air.

In the case of gaseous fuels, such as natural gas or propane, nitrogen contained in the gas fuel is not generally chemically bound with the fuel. Instead, the nitrogen is physically mixed with the gaseous fuel. Therefore, the small portion of nitrogen oxides produced by fuel bound nitrogen in gaseous fuels has little or no affect on the final emission level of nitrogen oxides from combustion product of gaseous fuels. The main component of nitrogen oxides produced during combustion of gaseous fuels is caused by oxidation of nitrogen contained in the combustion air.

Because of its relatively pollution free combustion characteristics, natural gas is the preferred fossil fuel for boilers and heating equipment in many areas of the United States, especially in southern California where the use of fuel oils is now strictly limited. Sever pollution problems have led authorities in southern California to impose stringent limits on emissions of nitrogen oxides. Conventional forced draft combustion devices are not capable of meeting these stringent limitations. Although southern California has the most stringent emission limitations on the emission levels of nitrogen oxides at the present time, many of the metropolitan areas across the United States are expected to impose similar stringent emission limitations in the near future. It is therefore necessary to design a system to reduce production of nitrogen oxides by combustion devices to an acceptable level.

One object of the present invention is to provide a system and method to reduce combustion derived nitrogen oxides in conventional boilers, water heaters, or other heat exchange or combustion devices.

Another object of the present invention is to improve fuel-air mixing within the burner assembly firing head and combustion zone.

Yet another object of the present invention is to provide a system which can be easily added to existing conventional forced gas boilers or incorporated into new boilers at a reduced expense from Previously available systems and methods of reducing nitrogen oxides.

Still another object of the present invention is to increase the thermal efficiency of combustion devices.

A further object of the present invention to improve combustion homogeneity to reduce emissions of partially burned or unburned fuel from combustion devices.

According to the present invention, an apparatus and method is provided for use with a boiler having a burner assembly, a combustion chamber, a flue for exhausting combustion product created by the burner assembly from the combustion chamber, and fuel supply means for supplying a fuel gas to the burner assembly. The apparatus includes means for mixing the fuel gas with an inert gas prior to introducing the fuel gas into the burner assembly. The apparatus also includes means for introducing the mixture of fuel gas and inert gas from the mixing means into the burner assembly.

The mixing means is formed to include a first inlet, a second inlet, and an outlet. The apparatus further includes means for supplying inert gas to the first inlet of the mixing means, and means for coupling the fuel supply means to the second inlet of the mixing means.

In a preferred embodiment of the present invention, the apparatus comprises a flue gas recirculation system including a housing configured to define a mixing region to combine fuel gas and combustion product from the combustion chamber of the boiler prior to introducing the fuel gas into the burner assembly. The housing is formed to include a first inlet, a second inlet, and an outlet. A pipe interconnects the flue of the boiler to the first inlet of the housing. A blower is used to force a portion of the combustion product through the pipe from the flue to the first inlet. The system further includes means for coupling the fuel supply means to the second inlet of the housing, and means for coupling the outlet of the housing to the burner assembly.

The means for coupling the fuel supply means to the second inlet includes at least one shutoff valve and a pressure regulator to control the flow rate of fuel gas into the housing. The pipe for interconnecting the flue and the first inlet includes a valve to control the flow rate of combustion product through the pipe, and a pressure switch to monitor the pressure of the combustion product delivered to the housing. The pressure switch stops recirculation of the combustion product if the pressure drops below a predetermined level.

The means for coupling the outlet of the housing to the burner assembly includes a mixture pipe having a valve to control the flow rate of the gas mixture from the housing to a gas manifold of the burner assembly in response to varying low demands of the burner assembly. The gas manifold is configured to direct flow of the gas mixture directly into a firing head of the burner assembly. The mixture of fuel gas and combustion product entering the gas manifold includes at least 30 percent combustion product.

The housing or mixing region includes a manifold and a nozzle situated inside the manifold. The nozzle is connected to the first inlet and is situated inside the manifold so that inert gas or combustion product entering the manifold through the nozzle is directed into a mixture pipe interconnecting the outlet of the manifold and the burner assembly where the combustion product mixes with fuel gas entering the housing through the second inlet.

One feature of the present invention is the provision of mixing means configured to mix fuel gas with an inert gas to dilute the fuel gas prior to introducing the fuel gas into the burner assembly. Advantageously, by mixing the fuel gas with the inert gas, the fuel gas is diluted which slows down the combustion reaction of the fuel gas in the burner assembly, thereby reducing the amount of nitrogen oxides formed as a result of the combustion reaction. The reduction in the production of nitrogen oxides is achieved without adversely affecting combustion stability, efficiency, or emissions of other pollutants such as carbon monoxide.

Another advantage gained by mixing the inert gas and the fuel gas is that the bulk volume of the fuel gas mixture is increased which permits better mixing of the fuel gas with the combustion air in the burner assembly.

Yet another advantage of mixing inert gas or flue gas with the fuel gas is that the fuel gas is warmed by the addition of hot flue gas. The warmer fuel gas mixture is able to mix more easily with combustion air and to burn more homogeneously in conventional forced draft burners in which air-fuel mixing is generally uneven.

Still another advantage of mixing inert gas with fuel gas prior to introducing the mixture into the burner assembly is that the thermal efficiency of the boiler is improved by increasing the bulk volume of gases passing through the heat exchanger situated inside the combustion chamber. Part of the heat content of the recycled flue gas is returned to the combustion chamber which increases the thermal efficiency of the boiler.

Another feature of the present invention is that the system can be added to existing boilers or incorporated into new boilers at a much lesser expense than is possible with previously available systems. Advantageously, the present system can be added to a boiler without requiring major modifications of boiler design or adversely affecting the normal operating characteristics such as combustion stability, ignition reliability, and combustion efficiency of the boiler.

In this specification and in the claims, the word "boiler" is intended to refer to various types of combustion devices, such as boilers, water heaters, or other heat exchange devices, in connection with which the present invention may be used. The term "inert gas" refers to a gas or mixture of gases substantially comprising gas or gases which will not burn in the presence of oxygen.

Additional objects, features and advantages of the invention will become apparent to those skilled in the art upon consideration of the following detailed description of the preferred embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

In typical combustion processes used in boilers, water heaters, heat exchangers, or other combustion devices, nitrogen oxides are formed and released into the atmosphere. Nitrogen oxides contribute heavily to the growing problem of air pollution and have been targeted by regulatory bodies for increasingly stringent controls and regulations.

One method that has been utilized to attempt to reduce the amount of nitrogen oxides produced during typical combustion processes is flue gas recirculation. Combustion products generated during a typical combustion process are often referred to as flue gas. Two separate types of prior art flue gas recirculation systems 10 and 30 are illustrated in FIGS. 1 and 2.

Figure 1:
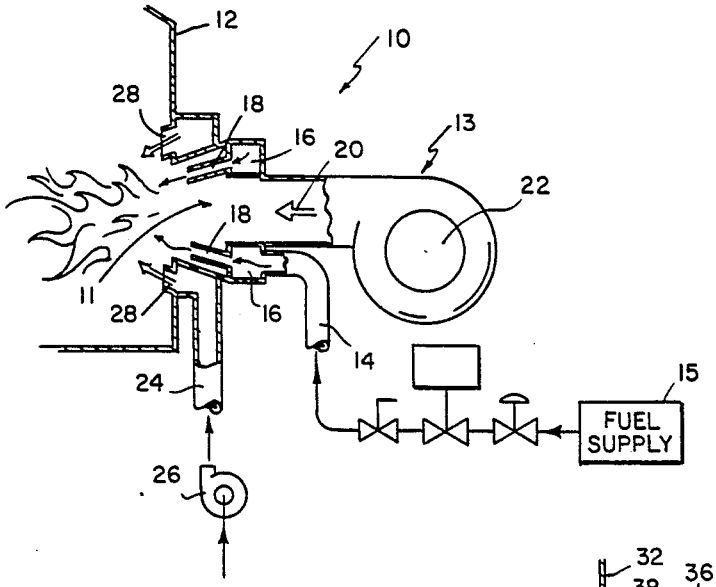
PRIOR ART FIG. 1
FIG. 1 is a diagrammatical illustration of the burner assembly of a prior art flue gas recirculation system showing two separate ports for introducing fuel gas and flue gas into the firing head.

In the flue gas recirculation system 10 illustrated in FIG. 1, flue gas and fuel gas are introduced into combustion zone or firing head 11 by separate ports 18 and 28, respectively. The flue gas recirculation system 10 includes a combustion chamber 12 of a conventional boiler and a burner assembly 13. Fuel gas is introduced into a gas manifold 16 of burner assembly 13 by pipe 14 which is connected to fuel gas supply means 15. Fuel gas then passes from gas manifold 16 through port 18 and into the firing head 11. Recirculated flue gas from a flue (not shown) of combustion chamber 12 is pumped through pipe 24 by blower 26. The flue gas passes through port 28 into the firing head 11. Combustion air, illustrated by arrow 20, is supplied to firing head 11 by blower 22 of burner assembly 13.

Figure 2:
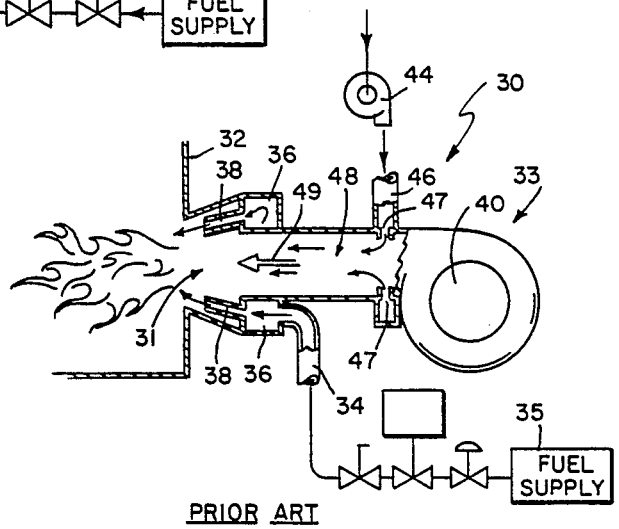
PRIOR ART FIG. 2
FIG. 2 is a diagrammatical illustration of another prior art flue gas recirculation system in which the flue gas is mixed with combustion air prior to entering the firing head.

In the flue gas recirculation system 30 shown in FIG. 2, recirculated flue gas is mixed with combustion air prior to entering combustion zone or firing head 31. Flue gas recirculation system 30 includes a combustion chamber 32 of a conventional boiler and a burner assembly 33. Fuel gas enters firing head 31 from fuel supply means 35 via pipe 34, fuel gas manifold 36, and port 38. Recirculated flue gas is pumped from a flue (not shown) of combustion chamber 32 by blower 44 through pipe 46. Pipe 46 is connected to a blast tube 48 of burner assembly 33 so that the flue gas passes through opening 47 formed in blast tube 48. Flue gas entering blast tube 48 through opening 47 combines with combustion air from a blower 40 of burner assembly 33. The mixture of flue gas and combustion air is then blown in the direction of arrow 49 into firing head 31 where the mixture of combustion air and flue gas is combined with the fuel gas entering firing head 31 through opening 38.

In each of the prior art, flue gas recirculation systems 10 and 30 shown in FIGS. 1 and 2, firing heads 11 and 31, respectively, receive a supply of undiluted fuel gas. This causes the flame intensity inside combustion chambers 12 and 32 to be extremely high. Such a high temperature flame causes a fast combustion reaction of the fuel gas in firing heads 11 and 31. As the speed of the combustion reaction increases, the amount of nitrogen oxides formed as a result of the combustion reaction also increases.

Figure 3:
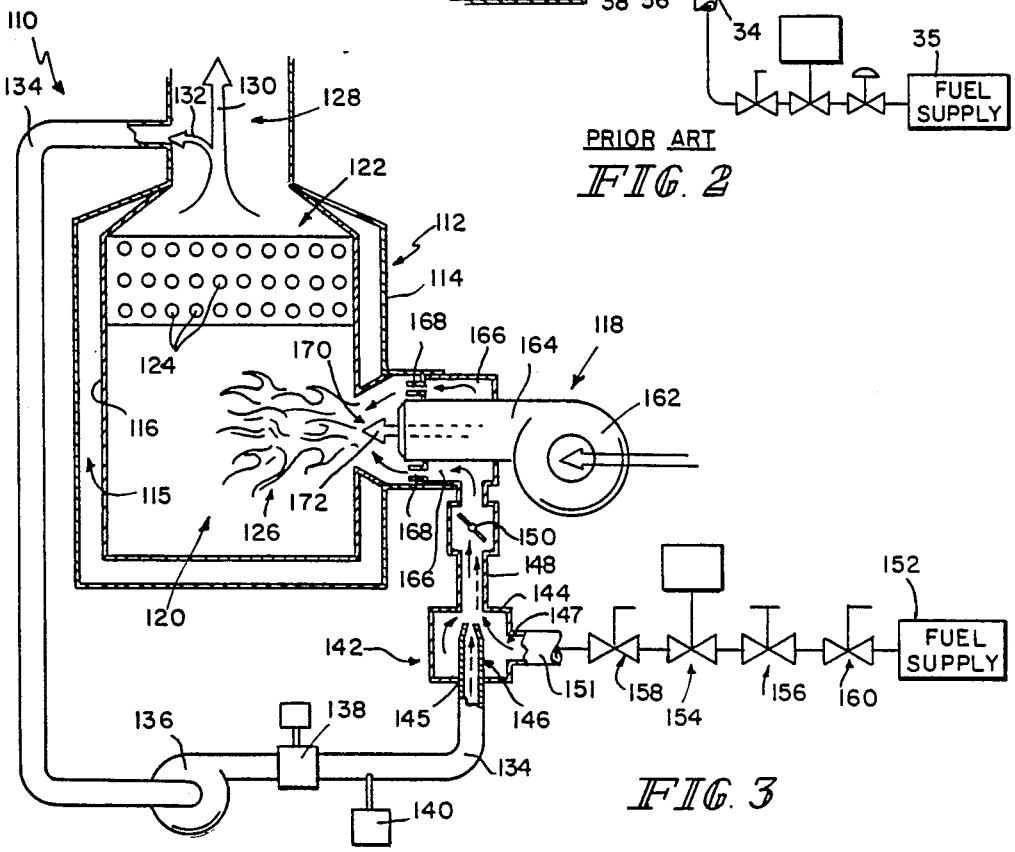
FIG. 3 is a diagrammatical illustration of a preferred embodiment of the present invention showing a flue gas recirculation system in which flue gas is mixed with fuel gas before the gas mixture is introduced into the burner assembly.

In the present invention, the flue gas recirculation system 110 shown in FIG. 3 reduces the intensity of the flame 126 generated by burner assembly 118 to reduce the amount of nitrogen oxides produced during the combustion process. Reduction of flame 126 intensity is accomplished by diluting the fuel gas with an inert gas such as combustion product or flue gas from an outlet or flue 128 of boiler 112 prior to introducing the fuel gas into burner assembly 118. The present invention is associated with the preparation of hydrocarbon fuel gases such as natural gas or propane, for example.

The flue gas recirculation system 110 of the present invention includes a boiler 112 having an outer wall 114 and an inner wall 116 figured to define a combustion chamber 120. The inner and outer walls 114 and 116 of boiler 112 can be cooled by circulation of water or other coolant inside region 115 formed between the inner and outer walls 114 and 116.

A heat exchanger 122 is mounted in an upper portion of combustion chamber 120. Heat exchanger 122 can include tubes 124 for carrying water, steam, or other heat transfer fluid. Boiler 112 is fired by burner assembly 118. A combustion reaction occurs inside combustion chamber 120 as shown by flame 126.

Combustion product from flame 126, commonly referred to as flue gas, passes through heat exchanger 122. Heat energy is passed from the flue gas to the heat transfer fluid located in tubes 124 of heat exchanger 122. Flue gas then exits combustion chamber 120 through flue 128 in the direction of arrow 130.

A portion 132 of the flue gas exiting combustion chamber 120 is directed into pipe 134 by recycle fan or blower 136. Blower 136 forces flue gas through valve 138 which may be either manually or automatically operated. A pressure switch 140 is provided to monitor the availability of a sufficient pressure of flue gas at the inlet 145 of a housing or mixing region 142. The pressure switch 140 stops recirculation of flue gas if the pressure drops below a predetermined level.

Flue gas continues to move through pipe 134 and enters mixing unit or region 142 through a nozzle 146 situated inside housing or manifold 144. In order to provide homogeneous mixing of flue gas and fuel gas, the mixing unit 142 is positioned in the fuel gas supply line to the burner assembly 118. Nozzle 146 is coupled to a first inlet 145 of manifold 144. A fuel supply pipe 151 is coupled to a second inlet 147 formed in manifold 144. Fuel gas supply means 152 supplies fuel gas to manifold 144. Fuel gas passes from fuel supply means 152 through valve 154 and regulator 156. Valve 154 and regulator 156 are backed up by one or more manual shutoff valves 158 and 160.

Flue gas under pressure is delivered by blower 136 through pipe 134 to nozzle 146. As the flue gas exists the nozzle, such pressure is converted into velocity energy and a jet of flue gas is directed from nozzle 146 into mixture pipe 148 as illustrated by the dotted arrow shown in mixture pipe 148 of FIG. 3.

Fuel gas is introduced from pipe 151 into manifold 144 through second inlet 147. Fuel gas moves in the direction of solid arrows shown in mixing region 142 through manifold 144 and into mixture pipe 148 where the fuel gas is combined with flue gas exiting nozzle 146.

It is understood that the fuel gas and flue gas could be mixed by reversing the connections on manifold 144 so that the fuel gas enters manifold 144 through nozzle 146 and the flue gas enters manifold 144 through second inlet 147. This alternate method may be used when constraints such as fuel gas supply pressure or the size of flue gas recycle fan 136 dictate.

The addition of flue gas to the fuel gas prior to introducing the fuel gas into burner assembly 118 has the effect of diluting the fuel gas which slows down the combustion reaction inside burner assembly 118. This reduces the amount of nitrogen oxides produced during the combustion reaction. The dilution of the fuel gas reduces the calorific value of the fuel gas.

The mixture of fuel gas and flue gas passes through mixture pipe 148 to metering valve 150 which may be manually or automatically activated to control gas flow to burner assembly 118 in response to load demands of burner assembly 118. The gas mixture enters burner assembly 118 through gas manifold 166. The gas mixture then passes through aperture or orifice 168 and into combustion zone or firing head 170. Blower 162 of burner assembly 118 delivers combustion air illustrated by arrow 172, through blast tube 164 to the firing head 170. Combustion air 172 mixes with the fuel gas mixture in firing head 170 and is ignited to produce flame 126. The diluted fuel gas causes a slower combustion reaction which results in reduced formation of nitrogen oxides.

The present invention significantly reduces the amount of nitrogen oxides introduced into the atmosphere during combustion process of the boiler. The following chart is a compilation of test data recorded from a boiler utilizing the flue gas recirculation system 110 of the present invention:

| 1 TEST REF | 2 FIRING RATE MBH | 3 REC ON/ OFF | 4 $O_2$ % | 5 TEST $NO_x$ PPM | 6 CORR. $NO_x$ PPM | 7 $NO_x$ W/ / $NO_x$ W/O | 8 FLUE GAS °F. | 9 NAT GAS °F. | 10 MIX GAS °F. | 11 % FLUE GAS |
|---|---|---|---|---|---|---|---|---|---|---|
| A | 2097.1 | ON | 4.0 | 20.0 | 21.20 | 40.3 | 194 | 78 | 155 | 66.4 |
| B | 2097.1 | OFF | 3.9 | 50.0 | 52.63 | | — | — | — | — |
| C | 2009.0 | ON | 4.5 | 16.0 | 17.45 | 43.5 | 207 | 75 | 158 | 62.9 |
| D | 2009.0 | OFF | 4.4 | 37.0 | 40.12 | | — | — | — | — |
| E | 2013.4 | ON | 4.4 | 10.3 | 11.11 | 27.7 | 214 | 72 | 201 | 90.8 |
| F | 2011.4 | ON | 4.5 | 9.0 | 9.82 | 24.5 | 226 | 71 | 179 | 69.7 |
| G | 4169.7 | ON | 3.8 | 21.0 | 22.04 | 53.4 | 186 | 79 | 117 | 35.5 |

-continued

| 1 TEST REF | 2 FIRING RATE MBH | 3 REC ON/ OFF | 4 $O_2$ % | 5 TEST $NO_x$ PPM | 6 CORR. $NO_x$ PPM | 7 $NO_x$ W/ / $NO_x$ W/O | 8 FLUE GAS °F. | 9 NAT GAS °F. | 10 MIX GAS °F. | 11 % FLUE GAS |
|---|---|---|---|---|---|---|---|---|---|---|
| H | 4116.7 | ON | 4.0 | 21.3 | 22.57 | 54.6 | 215 | 73 | 122 | 34.5 |
| I | 4452.3 | OFF | 4.0 | 39.0 | 41.30 | | — | — | — | — |
| J | 4156.0 | ON | 3.8 | 17.5 | 18.31 | 44.3 | 246 | 72 | 172 | 57.5 |

Various tests were run on the boiler at different burner firing rates and at different flue gas input rates. Natural gas was used as the fuel gas in each of the tests. The boiler that was modified to include the recirculation system 110 of the present invention was a standard steam boiler having a 4 million Btu/hour input. Records were kept during normal burner operation with no flue gas recirculation and when the flue gas recirculation system 110 of the present invention was turned on. The tests show that as the percent of flue gas contained in the gas mixture increases the ratio of nitrogen oxides in the flue gas exhausted from the combustion chamber decreases significantly.

Column 1 of the chart indicates the test reference letter for use during discussion of the test results. Column 2 shows the firing rate of the burner in each test. The firing rates were measured in thousands of BTUs per hour (MBH). Column 3 indicates whether the flue gas recirculation system 110 was on or off during a particular test.

Column 4 lists the measured oxygen percentage contained in the flue gas. In a natural gas fired boiler, flue gas generally contains between 3% and 8% oxygen. The remainder of the flue gas is composed mainly of nitrogen, carbon dioxide, water vapor, and some traces of other gases. Column 5 indicates the measured amount of nitrogen oxides present in the flue gas. The nitrogen oxides were measured in units of parts per million (PPM) by volume of nitrogen oxides contained in the flue gas. Column 6 shows the corrected nitrogen oxide level based on flue gas containing 3% oxygen. By correcting or adjusting the nitrogen oxide levels so that each level is based upon flue gas containing 3% oxygen, comparison of the respective nitrogen oxide levels in the different tests will more accurately reflect system performance. To obtain the value of nitrogen oxides corrected to reflect 3% oxygen in the flue gas the following formula is used:

$$\text{Corr. No}_x = (\text{Test NO}_x) \times \frac{(21 - 3)}{(21 - \text{O}_2\,\%)}$$

The corrected nitrogen oxide level (Corr. $No_x$) in units of PPM is listed in column 6, and the measured amount of nitrogen oxides (TEST $NO_x$) is listed in column 5. The percentage of oxygen ($O_2$%) used in the above calculation is listed in column 4.

Column 7 indicates the ratio of the amount of nitrogen oxides present in the flue gas with the recirculation system 110 on compared to the amount of nitrogen oxides present in the flue gas with the recirculation system 110 off. Comparison was made between tests having approximately the same firing rates with the recirculation system 110 turned on and with the recirculation system 110 turned off.

Tests A and B were compared. The amount of nitrogen oxides present when the recirculation system 110 was on in test A was only 40.3% of the amount of nitrogen oxides present in test B when the recirculation system 110 was off. Test C, with the recirculation system on, and test D, with the recirculation system off, were compared. Both tests C and D had firing rates of 2009.0 MBH. The amount of nitrogen oxides present in test C were only 43.5% of the amount of nitrogen oxides present in test D when the recirculation system 110 was off.

Tests E and F having firing rates of 2013.4 MBH and 2011.4 MBH, respectfully, and each having the recirculation system 110 turned on were compared with test D in which the recirculation system 110 turned off. The amounts of nitrogen oxides in test E were reduced to 27.7% of the amount present in test D, and the amount of nitrogen oxides present in test F were reduced to 24.5% of the amount present in test D.

Tests G, H, and J, all having the recirculation system 110 turned on, were compared to test I in which the recirculation system 110 was turned off. The nitrogen oxide levels in tests G, H, and J were reduced to 53.4%, 54.6%, and 44.3%, respectively, of the amount of nitrogen oxides present in test I.

Column 8 lists the temperature of flue gas recirculated from the flue 128 of combustion chamber 120 through pipe 134 and into mixing region 142. The temperature was measured in degrees Fahrenheit. No flue gas is recirculated when the recirculation system 110 is off, so no flue gas temperature measurements could be made.

Column 9 indicates the temperature in degrees Fahrenheit of the natural gas fuel supply entering mixing region 142 through supply pipe 151. Column 10 lists the temperature in degrees Fahrenheit of the mixture of natural gas and flue gas entering the burner assembly through mixing pipe 148 and valve 150.

Column 11 indicates the calculated percentage of flue gas contained in the mixture of flue gas and natural gas exiting mixing region 142. The calculation was made by first assuming that the specific heat of flue gas is approximately equal to the specific heat of natural gas. A variable (X) was chosen to represent the volume of natural gas in the mixture, and a variable (Y) was chosen to represent the volume of flue gas present in the gas mixture. The total volume of the mixture was set to equal 1. If $X+Y=1$, then X and Y are fractional volumes of the unit volume of the gas mixture and $X=1-Y$. Therefore, the fractional volume of natural gas present in the mixture (X) multiplied by the natural gas temperature (N.G.T.) added to the fractional volume of the flue gas in the mixture (Y) multiPlied by the flue gas temperature (F.G.T.) equals the total volume of the mixture of natural gas and flue gas ($X+Y$) multiplied by the mixture gas temperature (M.G.T.).

By inserting 1-Y for X in the above equation, it is possible to calculate the fractional volume of flue gas (Y) contained in the gas mixture. The equation and results are shown below:

Original Equation:

$$[X \times N.G.T.] + [Y \times F.G.T.] = (X + Y) \times (M.G.T.)$$

Inserting $X = 1 - Y$:

$$[(1 - Y) \times N.G.T.] + [Y \times F.G.T.] = (1 - Y + Y) \times (M.G.T.)$$

$$(Y) \times (F.G.T. - N.G.T.) = (M.G.T. - N.G.T.)$$

$$Y = \frac{(M.G.T. - N.G.T.)}{(F.G.T. - N.G.T.)}$$

Using the above equation, the percentage of flue gas contained in the mixture was calculated for each of the tests in which the recirculation system was turned on. The results of each calculation are shown in column 11.

Figure 4:
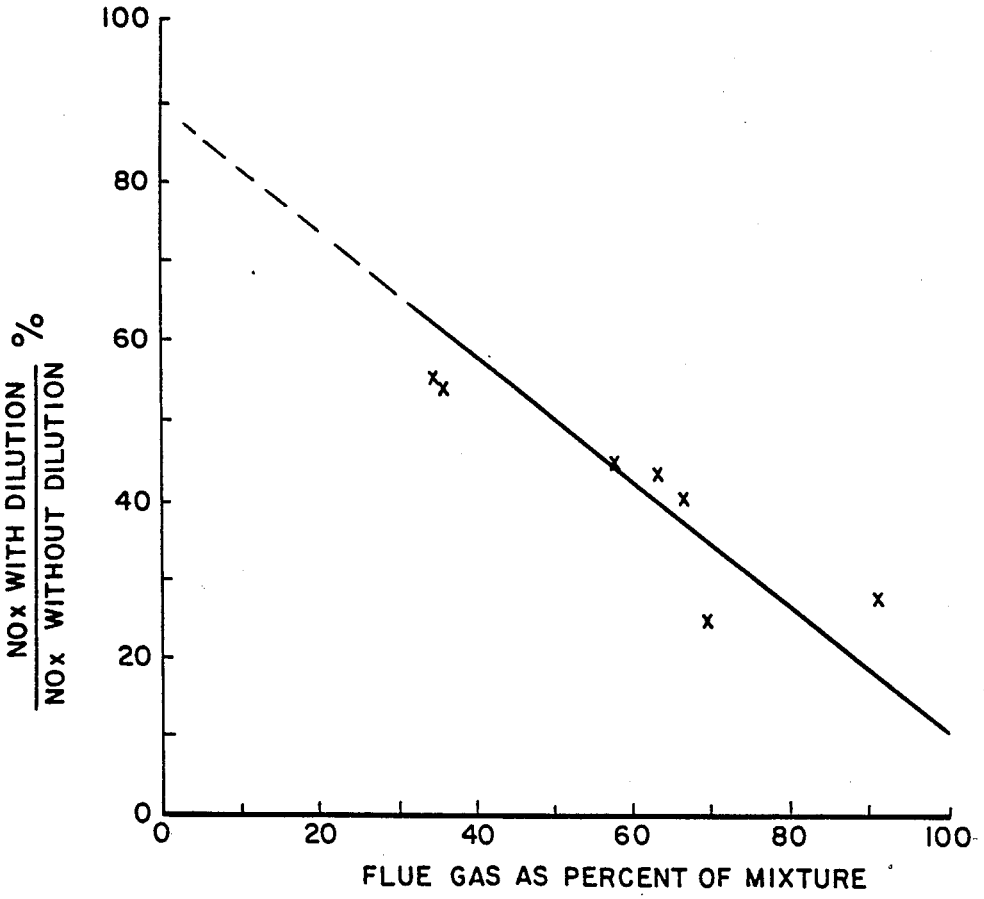
FIG. 4 is a graphical illustration of test results obtained from a boiler utilizing the embodiment of present invention illustrated in FIG. 3 showing a reduction in the level of nitrogen oxides contained in combustion product of the boiler as the percentage of flue gas contained in the mixture increases.

FIG. 4 is a graph of the test results. The vertical axis of the graph represents the ratio of the amount of nitrogen oxides present with the recirculation system 110 on compared with the amount of nitrogen oxides present when the recirculation system 110 is off. The horizontal axis of the graph represents the percentage of flue gas contained in the gas mixture. The values plotted on the graph were obtained from columns 7 and 11 for each of the tests in which the flue gas recirculation system 110 was turned on. The line drawn on the graph is the best fit straight line for the points plotted on the graph using the least squares method. As can be seen from FIG. 4, the gas mixture should include at least 30% flue gas to achieve a reduction in nitrogen oxides of about 35% or greater. The preferred range for beneficial $NO_x$ reduction is 30% to 80% flue gas.

In addition to the specific embodiment of the present invention disclosed in FIG. 3, it is understood that similar results may be obtained by diluting the fuel gas with an inert gas at any location along the fuel gas supply stream. This dilution can be accomplished from a supply of inert gas mixed with the fuel gas either in mixing region 142, at a remote location such as a central treatment plant used for a number of boilers 112 at a particular location, or at any location prior to final use of the gas mixture for combustion. Similar results may also be obtained by diluting the fuel gas with inert gases at the gas utility level as far back as the natural gas well.

Although the invention has been described in detail with reference to a preferred embodiment, variations in modifications exist within the scope and spirit of the invention as described and defined in the following claims.

What is claimed is:

1. A flue gas recirculation system for reducing the amount of nitrogen oxides produced and discharged by a boiler having a burner assembly, a combustion chamber, a flue for exhausting combustion product created by the burner assembly from the combustion chamber, and fuel supply means for supplying fuel gas to the burner, the flue gas recirculation system comprising a housing configured to define a mixing region to combine fuel gas and combustion product prior to introducing the fuel gas to the burner assembly to produce a mixture of fuel gas and combustion product containing at least 30 % combustion product, the housing being formed to include a first inlet, a second inlet, and an outlet, a pipe for interconnecting the flue of the boiler to the first inlet of the housing, the pipe including a value to control the flow rate of the combustion product through the pipe, a blower to force a portion of the combustion product through the pipe from the flue to the first inlet, means for coupling the fuel supply means to the second inlet of the housing, means for coupling the outlet of the housing to the burner assembly to introduce the mixture of fuel gas and combustion product into the burner assembly, and a pressure switch coupled to the pipe for monitoring pressure of the combustion product delivered to the housing, the pressure switch including means for disabling the blower to stop recirculation of the combustion product in response to the pressure falling below a predetermined level.

2. The system of claim 1 wherein the means for coupling the fuel supply means to the second inlet includes at least one shutoff value and a pressure regulator to control the flow rate of fuel gas into the housing.

3. The system of claim 1, wherein the means for coupling the outlet of the housing to the burner assembly includes a mixture pipe having a value to control the flow rate of the gas mixture from the housing to a gas manifold of the burner assembly in response to varying load demands of the burner assembly.

4. The system of claim 3, wherein the gas manifold is configured to direct the flow of the gas mixture directly into a firing head of the burner assembly.

5. The apparatus of claim 1, further comprising a nozzle situated inside the housing and means for connecting the nozzle to the first inlet.

6. The apparatus of claim 5, further comprising a mixture pipe interconnecting the outlet of the housing and the burner assembly, the nozzle being situated inside the housing so that the combustion product entering the housing through the nozzle is directed into the mixture pipe.

7. A flue gas recirculation system for reducing the amount of nitrogen oxides produced and discharged by a boiler having a burner assembly, a combustion chamber, a flue for exhausting combustion product created by the burner assembly from the combustion chamber, and fuel supply means for supplying fuel gas to the burner, the flue gas recirculation system comprising a housing configured to define a mixing region to combine fuel gas and combustion product prior to introducing the fuel gas to the burner assembly to produce a mixture of fuel gas and combustion product containing at least 30% combustion product, the housing being formed to include a first inlet, a second inlet, and an outlet, a pipe for interconnecting the flue of the boiler to the first inlet of the housing, a blower to force a portion of the combustion product through the pipe from the flue to the first inlet, means for coupling the fuel supply means to the second inlet of the housing, means for coupling the outlet of the housing to the burner assembly to introduce the mixture of fuel gas and combustion product into the burner assembly, and a pressure switch coupled to the pipe for monitoring pressure of the combustion product delivered to the housing, the pressure switch including means for disabling the blower to stop recirculation of the combustion product in response to the pressure falling below a predetermined level.

8. The system of claim 7, wherein the means for coupling the fuel supply means to the second inlet includes at least one shutoff valve and a pressure regulator to control the flow rate of fuel gas into the housing.

9. The system of claim 7, wherein the means for coupling the outlet of the housing to the burner assembly includes a mixture pipe having a valve to control the flow rate of the gas mixture from the housing to a gas manifold of the burner assembly in response to varying low demands of the burner assembly.

10. The system of claim 9, wherein the gas manifold is configured to direct the flow of the gas mixture directly into a firing head of the burner assembly.

11. The system of claim 7 further comprising a nozzle situated inside the housing and means for connecting the nozzle to the first inlet.

12. The system of claim 11, further comprising a mixture pipe interconnecting the outlet of the housing and the burner assembly, the nozzle being situated inside the housing so that the combustion product entering the housing through the nozzle is directed into the mixture pipe.

13. A method of reducing the amount of nitrogen oxides produced and discharged by a boiler which includes a burner assembly, a combustion chamber, a flue for exhausting combustion product created by the burner assembly from the combustion chamber, and fuel supply means for supplying a fuel gas to the burner assembly, the method comprising the steps of:

providing a housing having a first inlet, a second inlet, and an outlet, removing a portion of the combustion product from the flue, introducing the portion of the combustion product removed from the flue into the housing through the first inlet, introducing a fuel gas into the housing through the second inlet to produce a mixture of combustion product and fuel gas containing at least 30% combustion product, connecting the output of the housing to the burner assembly to supply the mixture of combustion product and fuel gas to a firing head of the burner assembly, monitoring the pressure of the portion of the combustion product delivered to the housing from the flue, and stopping removal of the combustion product from the flue in response to the pressure falling below a predetermined level.

* * * * *